US006502360B2

(12) United States Patent
Carr, III et al.

(10) Patent No.: US 6,502,360 B2
(45) Date of Patent: Jan. 7, 2003

(54) SINGLE-PLY ROOFING MEMBRANE WITH LAMINATED, SKINNED NONWOVEN

(75) Inventors: Richard W. Carr, III, Spartanburg, SC (US); Steven R. Clarke, Mount Holly Springs, PA (US); John G. Mitchell, Martinsville, VA (US)

(73) Assignees: Thantex Specialties, Inc., Arden, NC (US); Carlisle Management Co., Syracuse, NY (US)

( * ) Notice: Subject to any disclaimer, the term of this patent is extended or adjusted under 35 U.S.C. 154(b) by 93 days.

(21) Appl. No.: 09/817,995

(22) Filed: Mar. 27, 2001

(65) Prior Publication Data

US 2002/0139076 A1 Oct. 3, 2002

(51) Int. Cl.[7] ..... E04B 5/00; B32B 33/00

(52) U.S. Cl. ..... 52/408; 52/409; 52/746.11; 428/42.2

(58) Field of Search ..... 52/90.1, 302.1, 52/408, 409, 741.4, 745.06, 745.21, 746.1, 746.11

(56) References Cited

U.S. PATENT DOCUMENTS 4,766,029 A 8/1988 Brock, et al.
5,456,785 A * 10/1995 Venable ..... 156/229
5,620,554 A 4/1997 Venable
5,643,399 A 7/1997 Venable
5,800,891 A * 9/1998 Wasitis ..... 428/194
5,925,581 A 7/1999 Tolbert
6,108,993 A * 8/2000 Hageman ..... 52/309.8
6,360,506 B1 * 3/2002 Graae ..... 156/292
6,416,854 B2 * 7/2002 Hunter, Jr. ..... 428/306.6

OTHER PUBLICATIONS

U.S. patent application Ser. No. 09/238,678, Clarke, filed Jan. 26, 1999.

Carlisle Syntec Incorporated, "855119—FB–FA System Submittal Sheet" Product Bulletin, (1999).

Carlisle Syntec Incorporated, "600545—FB System Components Briefolio" Product Bulletin, (2000).

Carlisle Syntec Incorporated, "Sure–Seal(R) HM "Hot Mopped" Roofing System", (Aug. 2000).

* cited by examiner

*Primary Examiner*—Carl D. Friedman
*Assistant Examiner*—Kevin McDermott
(74) *Attorney, Agent, or Firm*—Robert H. Hammer III

(57) ABSTRACT

This invention is directed to a membrane laminate for a roofing system comprising a membrane sheet and a nonwoven material laminated to said sheet. The nonwoven material has a semi-permeable, skinned layer formed therein.

20 Claims, 2 Drawing Sheets

SINGLE-PLY ROOFING MEMBRANE WITH LAMINATED, SKINNED NONWOVEN

FIELD OF THE INVENTION

This invention is directed to a single-ply roofing membrane having a nonwoven laminated thereto (laminated membrane), the roof system using the laminated membrane, the method of installing the roofing system, and the nonwoven material laminated to the membrane.

BACKGROUND OF THE INVENTION

In commercial, flat roofs, there are three popular roofing systems in use today. Those roofing systems are: built-up roofs (BUR), modified bitumen, and single-ply or membrane roofing systems. The commercial flat roof market is divided roughly equally between those three roofing systems.

Single-ply roofing systems are known. Single-ply laminated membranes are known. For example, see U.S. Pat. Nos. 5,456,785, 5,620,554, and 5,643,399. Typically, these laminated membranes comprise a membrane, made from EPDM or other thermoplastic material, and a nonwoven (or fleecy material) adhered on one surface of the membrane. The nonwoven material is provided to facilitate adherence of the membrane, via an asphalt (or bitumen) or a proprietary adhesive formulation, to the sub-roof structure. The commercially available, laminated membranes have been readily accepted by the market, when used with the proprietary adhesive formulation. Acceptance by roofers wishing to use asphalt as the adherent, however, has been slower. The problem hindering acceptance in asphalt adhered systems is known as "strike through." Strike through arises when the asphalt is spread over a roof or roof decking, and the laminated membrane is laid into the molten asphalt. If the asphalt application is too thick, the asphalt can saturate the fleece layer and come into contact with the polymer membrane. Some components of the molten asphalt, a petroleum based material, are absorbed by the membrane causing swelling and discoloration of the membrane. The swelling and discoloration are visible, after the laminated membrane is installed, and are considered an installation defect.

One solution to the strike through problem is set forth in U.S. patent application Ser. No. 09/238,678 filed on Jan. 26, 1999, inventor S. R. Clarke, assigned to Carlisle Syntec. The solution disclosed therein consists of a membrane laminate in which a membrane sheet and a nonwoven layer sandwich a protective layer. The protective layer is a discrete layer or film (i.e., not a part of the nonwoven) made of a material resistant to the components of the molten asphalt (i.e., polyester, polyurethane, polyetherurethane, and the like).

Accordingly, there is a need for a membrane laminate for use in asphalt adhered single-ply laminated roofing systems that eliminates or reduces the occurrence of "strike through."

SUMMARY OF THE INVENTION

This invention is directed to a membrane laminate for a roofing system comprising a membrane sheet and a nonwoven material laminated to said sheet. The nonwoven material has a semipermeable, skinned layer formed therein.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
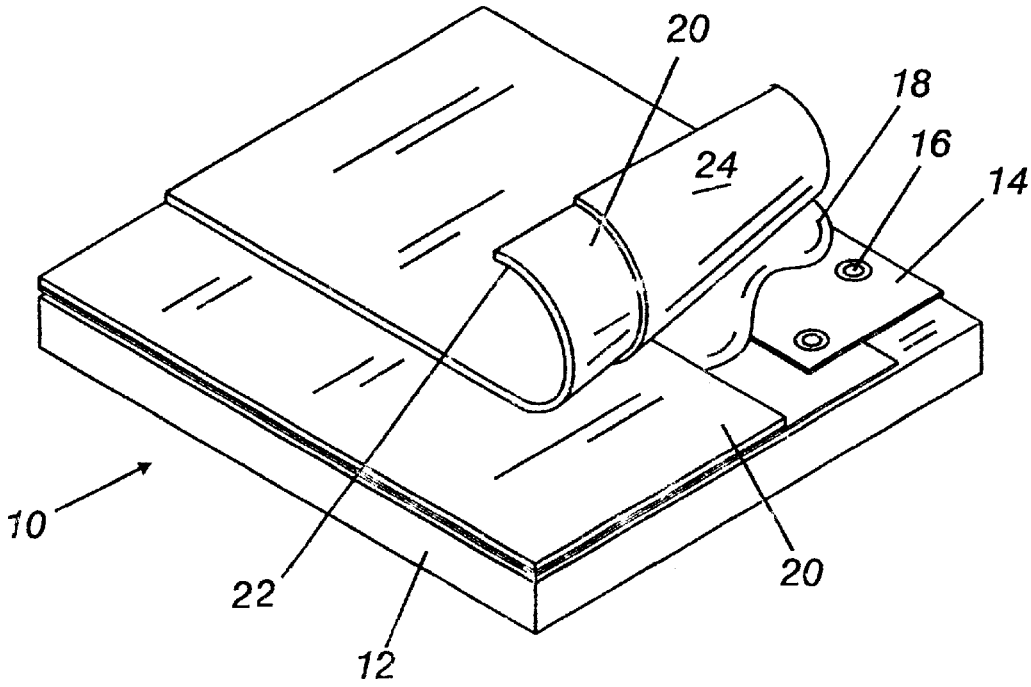
FIG. 1 is a schematic illustration of a first roof system utilizing the instant invention.

Referring to the drawings wherein like numerals indicate like elements, there is shown in FIG. 1 a first embodiment of the instant invention. Roof system 10 illustrates new construction. Roofing system 10 includes a substrate system 12. Substrate system 12 is well known in the art and may include: gypsum and fibrous cement, light weight concrete, structural concrete, plywood, or steel decking. A base sheet 14 is laid over top of the substrate system 12. Base sheet 14 is any commercially available base sheet material. Such base sheet materials include: fiberglass-coated base sheets, glass fiber reinforced base sheets, and polyester base sheets. Base sheet fastener 16 attach the base sheet 14 to the sub-roof system 12. Molten asphalt 18, discussed below, is spread over top of base sheet 14. Laminated membrane 20 is laid out over the molten asphalt. Laminated membrane 20, discussed below, comprises a membrane 22 with a nonwoven 24 laminated thereto. Molten asphalt 18 penetrates into nonwoven 24 and then solidifies, thereby adhering the laminated membrane 20 to sub-roof 12 via asphalt 18 and base sheet 14.

Figure 2:
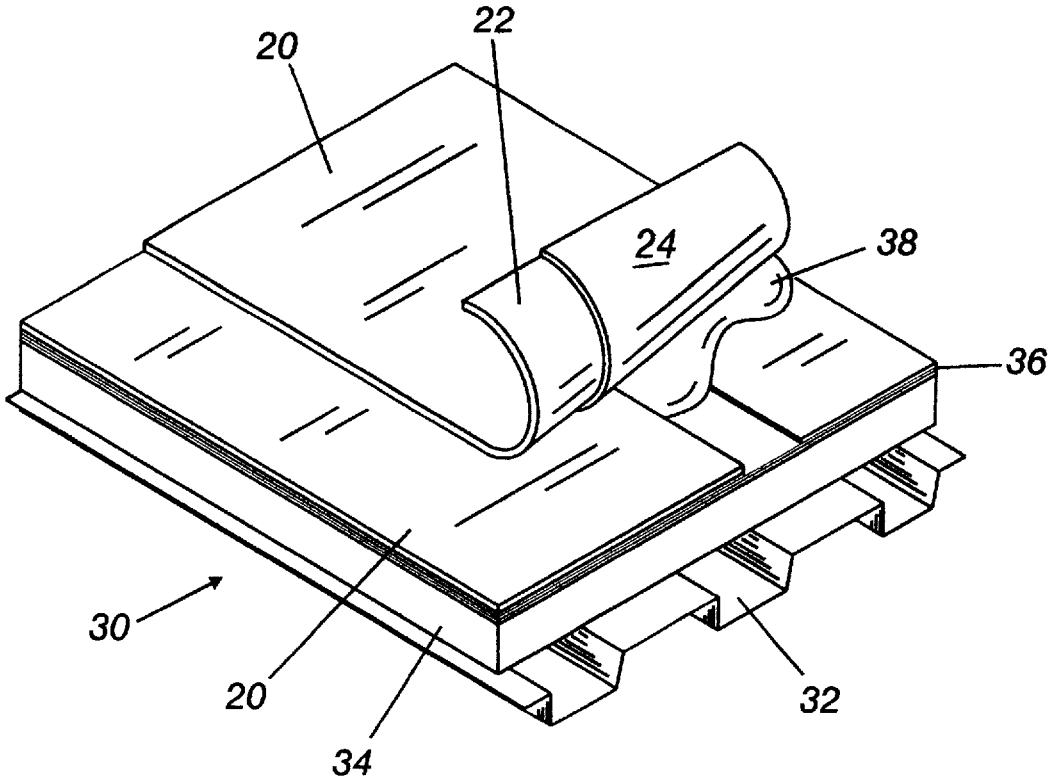
FIG. 2 is a schematic illustration of a second roof system utilizing the instant invention.

Referring to FIG. 2, a second roofing system 30 is illustrated. Roofing system 30 illustrates a typical re-roofing in which the invention is installed over an existing roof. Roofing system 30 may generally include a substrate system 32, pre-existing insulation 34, pre-existing roofing 36, and the new roofing system. The substrate system may be: gypsum and fibrous cement, light weight concrete, structural concrete, plywood, or steel decking. Pre-existing roofing 36 may include, for example, smooth surface BUR, gravel surface BUR, existing single-ply roofing, or a modified bitumen roofing material. Asphalt 18, discussed below, is applied over the pre-existing roofing 36 beneath laminated membrane 20.

Asphalts 18 and 38 are any conventionally used asphalt (or bitumen) materials. Such asphalts include Type III, IV, and modified asphalts, SBS or SEBS asphalts. These asphalts preferably should meet or conform to the requirements set out in ASTM D312, incorporated herein by reference.

The membrane 20 comprises a membrane 22 and a nonwoven material 24. Laminated membrane 20 is made according to the processes set forth in U.S. Pat. Nos. 5,456,785, 5,620,554, and 5,643,399, each of which is incorporated herein by reference. The skinned nonwoven of this invention is placed on the membrane such that the skinned side of the nonwoven would be juxtaposed to the hot asphalt.

The membrane 22 is a flexible vulcanized rubber sheet, e.g., a synthetic rubber or thermoplastic rubber-type material. The sheet may be made from EPDM (ethylene propylene diene monomer) or TPO (thermoplastic olefin), PVC (polyvinyl chloride), CSPE (chlorosulfonated polyethylene), EPM (ethylene propylene monomer) and other suitable materials. Preferably, membrane 22 is an EDPM sheet. The membrane typically has a thickness of 30 to 90 mils, the preferred thickness is 45 to 60 mils.

The nonwoven 24 has a semi-permeable, skinned layer formed therein. This semi-permeable skin retards the penetration of the molten asphalt into the nonwoven, thereby protecting the membrane from the asphalt. This prevents or significantly reduces the foregoing strike through problem. The nonwoven 24 typically has a basis weight of 1 to 20 ounces per square yard, preferably 3 to 20ounces per square yard, and most preferably 6 to 9 ounces per square yard. The foregoing skinned nonwoven may be a blend of structural fibers and fusible fibers. The structural fibers (staple or filament) are preferably thermoplastic fibers, for example, polyester or polypropylene or composite (or bi-component) fibers. The fusible fibers are preferably polypropylene staple, but may include polyethylene, composite (or bi-component) fibers. The blend ratio of structural fibers and fusible fibers may be 50–50weight blend, more preferred are blends ranging from 60–40 to 90–10, and most preferred, being 80–20. The preferred skinned nonwoven is an 80–20 weight blend of polyester staple (4 denier, 2.5" cut length) and polypropylene staple (either 3 denier, 3.25" cut length or 3.25 denier, 3.25" cut length) and has a basis weight of 7.5 oz/yard±10%.

The skinned nonwoven is made by carding the structural fibers and fusible fibers to form a web, cross lapping the web (15 layers) to form a batt, drafting the batt, needle punching the drafted batt, and calendering the punched batt. The calendering step is used to form the skin that imparts semi-permeability to the nonwoven. During the calendering step the fusible fiber, which is interspersed within the nonwoven melts, or partially melts, at the side of the nonwoven adjacent the heated calender roll. The molten fusible fiber fills up, at least in part, interstitial spaces of the nonwoven thereby forming a skin, which is semi-permeable. The skin is formed on one side of the nonwoven. The calender pressure is 200 newtons and the heated roll temperature is 215° C. for the preferred nonwoven, i.e., the foregoing 80–20 weight blend of polyester staple and polypropylene staple.

The present invention may be embodied in other specific forms without departing form the spirit or essential attributes thereof, and, accordingly, reference should be made to the appended claims, rather than the foregoing specification, indicating the scope of the invention.

What is claimed is:

1. A flat roof comprising:

a sub-roof system;

a layer of asphalt;

a layer of membrane laminate comprising a membrane and a nonwoven material, said nonwoven material and said membrane being laminated together, said nonwoven material having a semi-permeable, skinned layer formed therein; and said layer of asphalt adhering said laminate to said sub-roof.

2. The roof of claim 1 wherein said nonwoven material comprises a blend of a structural fiber and a fusible fiber.

3. The roof of claim 1 wherein said nonwoven material comprises a blend of a polyester fiber and a fusible fiber.

4. The roof of claim 1 wherein said nonwoven material comprises a basis weight of about 1 to about 20 ounces per square yard.

5. The roof of claim 1 wherein said asphalt being selected from the group consisting of: Type III, Type IV, modified, SBS, SEBS asphalts, and combinations thereof.

6. The roof of claim 1 wherein said sub-roof system comprises either a substrate or a pre-existing roof.

7. The roof of claim 1 wherein said membrane further comprises a flexible vulcanized rubber sheet.

8. A method of constructing a roofing system comprising:

providing a sub-roof system;

applying a layer of hot asphalt on said sub-roof system; and applying a membrane laminate to said hot asphalt, said membrane laminate comprising a membrane material laminated to a nonwoven material, said nonwoven material having a semi-permeable-skinned layer formed therein.

9. The roof of claim 8 wherein said nonwoven material comprises a blend of a structural fiber and a fusible fiber.

10. The roof of claim 8 wherein said nonwoven material comprises a blend of a polyester fiber and a fusible fiber.

11. The roof of claim 8 wherein said nonwoven material comprises a basis weight of about 1 to about 20 ounces per square yard.

12. The roof of claim 8 wherein said membrane further comprises a flexible vulcanized rubber sheet.

13. A membrane laminate for a roofing system comprising a membrane sheet and a nonwoven material having a semi-permeable skin layer formed therein, said nonwoven material adhered to said membrane sheet.

14. The roof of claim 13 wherein said nonwoven material comprises a blend of a structural fiber and a fusible fiber.

15. The roof of claim 13 wherein said nonwoven material comprises a blend of a polyester fiber and a fusible fiber.

16. The roof of claim 13 wherein said nonwoven material comprises a basis weight of about 1 to about 20 ounces per square yard.

17. The roof of claim 13 wherein said membrane further comprises a flexible vulcanized rubber sheet.

18. A method of using a nonwoven material for a membrane laminate used in a roofing system comprising the steps of providing a blend of a structural fiber and a fusible fiber adapted to retard penetration of asphalt into said nonwoven material and to reduce or prevent asphalt volatiles from contacting said membrane.

19. The roof of claim 18 wherein said nonwoven material comprises a basis weight of about 1 to about 20 ounces per square yard.

20. The roof of claim 18 wherein said membrane further comprises a flexible vulcanized rubber sheet.

* * * * *